US012117266B1

(12) United States Patent
Christiansen

(10) Patent No.: US 12,117,266 B1
(45) Date of Patent: Oct. 15, 2024

(54) LASER DOT SIGHT DEVICE

(71) Applicant: Adam Christiansen, Palmer, AK (US)

(72) Inventor: Adam Christiansen, Palmer, AK (US)

( * ) Notice: Subject to any disclaimer, the term of this patent is extended or adjusted under 35 U.S.C. 154(b) by 0 days.

(21) Appl. No.: 18/212,237

(22) Filed: Jun. 21, 2023

(51) Int. Cl.
*F41G 1/30* (2006.01)

(52) U.S. Cl.
CPC ..... *F41G 1/30* (2013.01)

(58) Field of Classification Search
CPC ..... F41G 1/30
USPC ..... 42/113
See application file for complete search history.

(56) References Cited

U.S. PATENT DOCUMENTS 1,743,906 A 1/1930 Valeriano
3,294,963 A * 12/1966 Carn ..... G02B 23/12 356/138
3,641,676 A * 2/1972 Knutsen ..... F41G 1/32 42/145
4,695,159 A 9/1987 Cannon
5,653,034 A 8/1997 Bindon
5,887,352 A * 3/1999 Kim ..... F41G 1/08 42/144
5,901,452 A 5/1999 Clarkson
5,926,963 A * 7/1999 Knight ..... F41G 1/345 42/132
7,234,265 B1 6/2007 Cheng
7,739,825 B2 * 6/2010 LoRocco ..... F41G 1/345 42/111
8,529,083 B1 9/2013 Reed
D872,219 S 1/2020 Horton
2002/0056220 A1 * 5/2002 Hoadley ..... F41G 1/467 42/111
2008/0184609 A1 * 8/2008 Schulst ..... F41G 1/42 42/111
2011/0283589 A1 * 11/2011 Matthews ..... F41G 1/30 42/113
2012/0151816 A1 * 6/2012 Kleck ..... F41G 1/30 42/111
2012/0198750 A1 * 8/2012 Mansfield ..... F41G 1/345 42/145
2013/0283660 A1 * 10/2013 Matthews ..... F41G 1/26 42/118
2013/0319216 A1 * 12/2013 Poirier ..... F41A 21/32 42/114
2023/0112868 A1 * 4/2023 York ..... F41G 1/44 42/123

FOREIGN PATENT DOCUMENTS

EP 0160766 11/1985

* cited by examiner

*Primary Examiner* — Bret Hayes

(57) ABSTRACT

A laser dot sight device includes a red dot sight that is mountable to a firearm to facilitate a shooter to aim the firearm with the red dot sight. The red dot sight includes an emitter housing, a lens housing extending upwardly from the emitter housing and a lens that is integrated into the lens housing. The lens housing is comprised of a translucent material thereby facilitating light to pass through the lens housing. In this way the lens housing can facilitate the shooter to have unimpeded peripheral vision while looking through the red dot sight.

12 Claims, 8 Drawing Sheets

LASER DOT SIGHT DEVICE

CROSS-REFERENCE TO RELATED APPLICATIONS

Statement Regarding Federally Sponsored Research or Development

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to laser sight devices and more particularly pertains to a new laser sight device for facilitating peripheral vision while looking through a laser sight on a firearm. The device includes a red dot sight that has a lens housing which is comprised of a translucent material. In this way the lens housing facilitates a shooter to have unimpeded peripheral vision while the shooter is looking through the lens housing to aim the firearm.

(2) Description of Related Art Including Information Disclosed Under 37 CFR 1.97 and 1.98

The prior art relates to laser sight devices including a variety of laser sights for firearms and a laser sight that has a cubic and transparent housing. In no instance does the prior art disclose a red dot sight that has a transparent lens housing to facilitate unimpeded peripheral vision for a shooter while the shooter is aiming through the lens housing.

BRIEF SUMMARY OF THE INVENTION

An embodiment of the disclosure meets the needs presented above by generally comprising a red dot sight that is mountable to a firearm to facilitate a shooter to aim the firearm with the red dot sight. The red dot sight includes an emitter housing, a lens housing extending upwardly from the emitter housing and a lens that is integrated into the lens housing. The lens housing is comprised of a translucent material thereby facilitating light to pass through the lens housing. In this way the lens housing can facilitate the shooter to have unimpeded peripheral vision while looking through the red dot sight.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
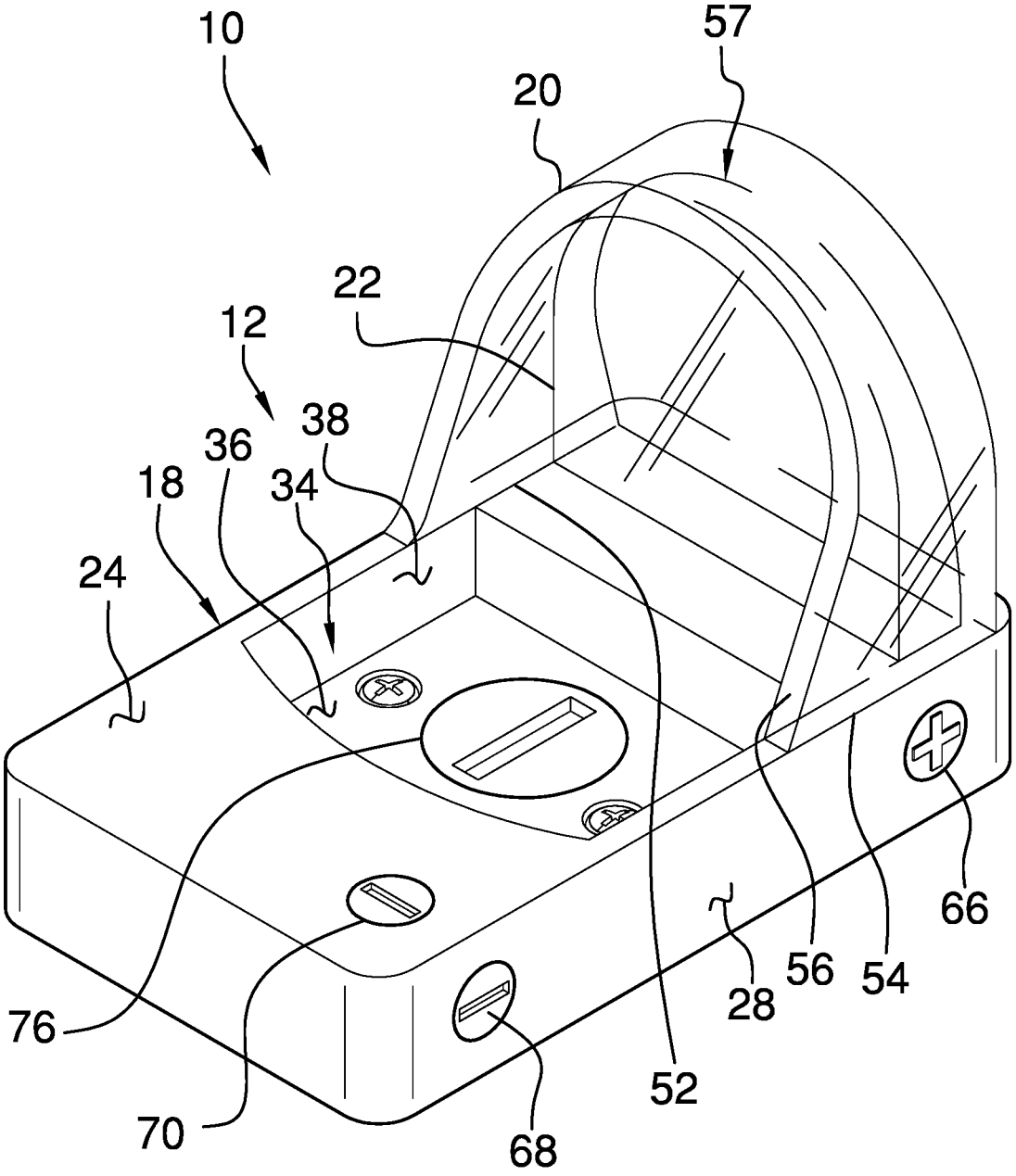
FIG. 1 is a back perspective view of a laser dot sight device according to an embodiment of the disclosure.
Figure 2:
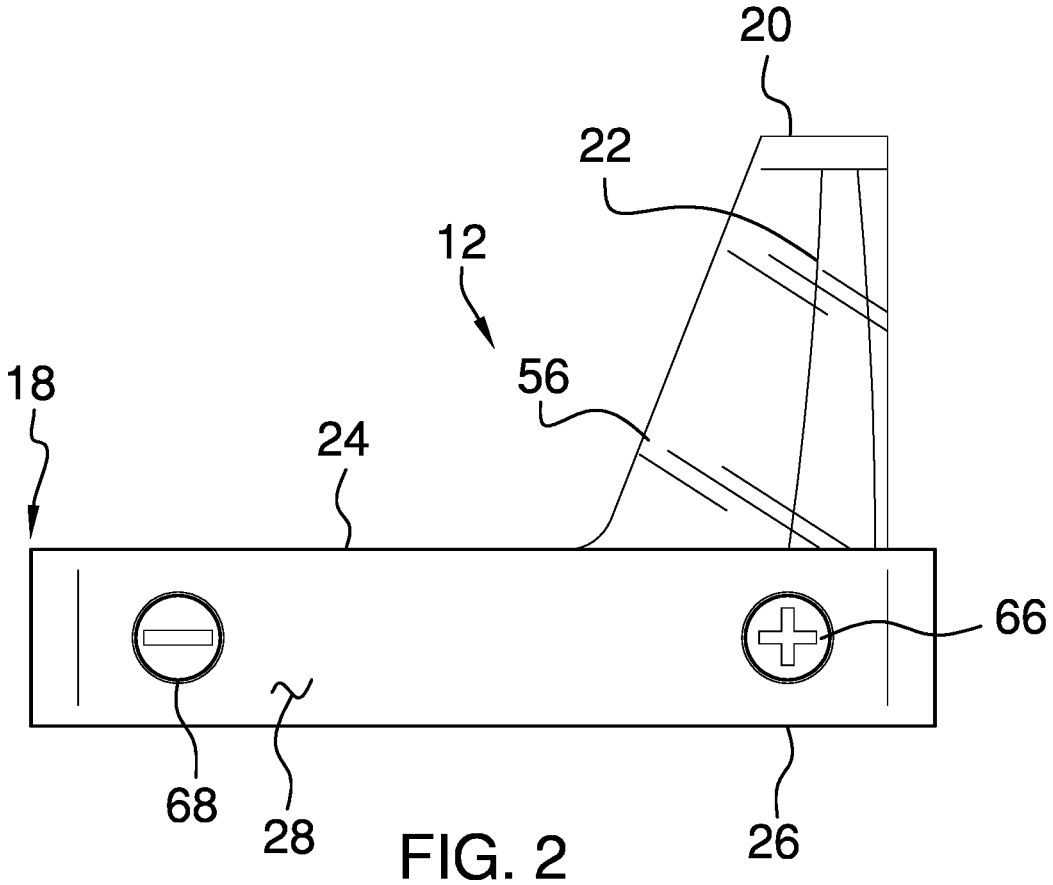
FIG. 2 is a right side view of an embodiment of the disclosure.
Figure 3:
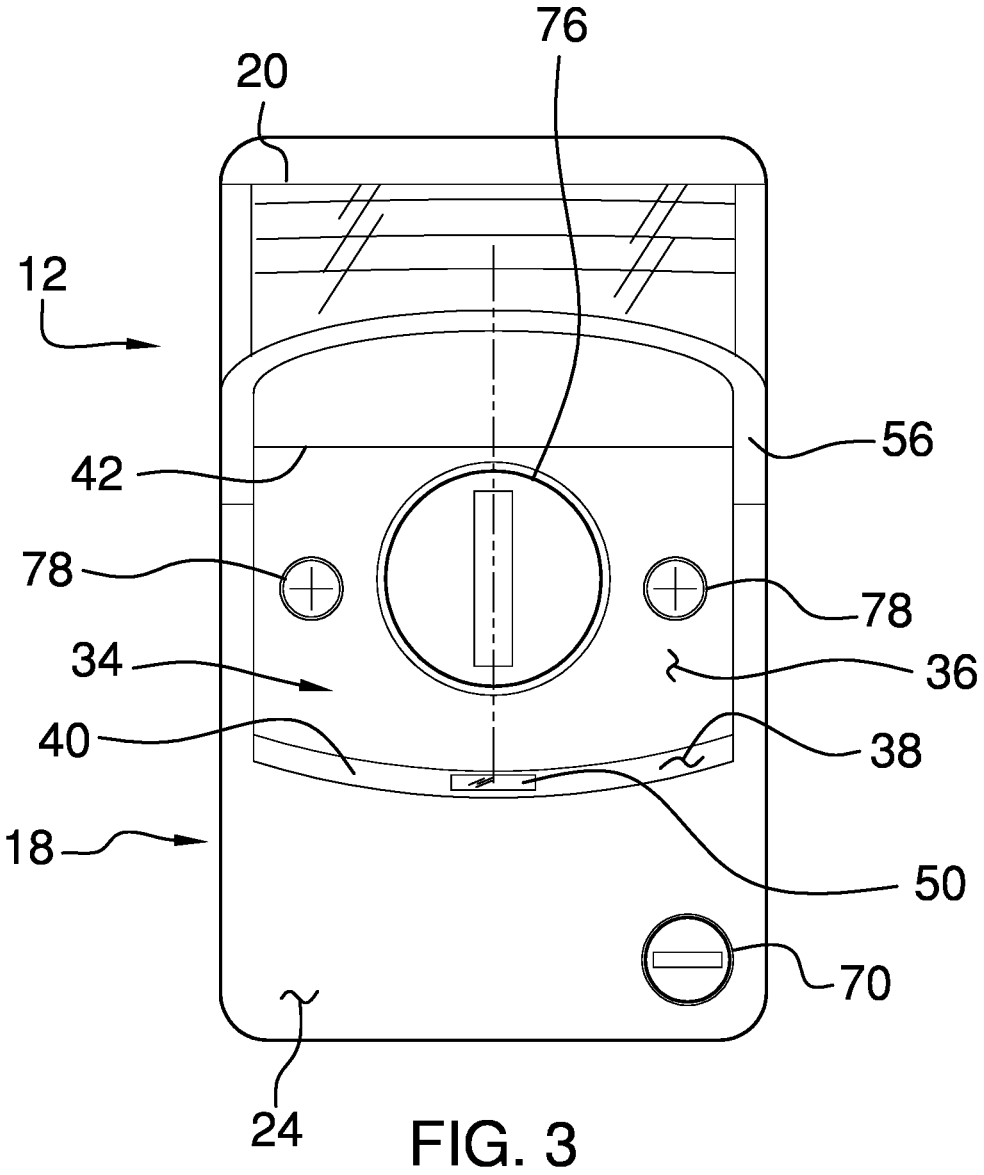
FIG. 3 is a top view of an embodiment of the disclosure.
Figure 4:
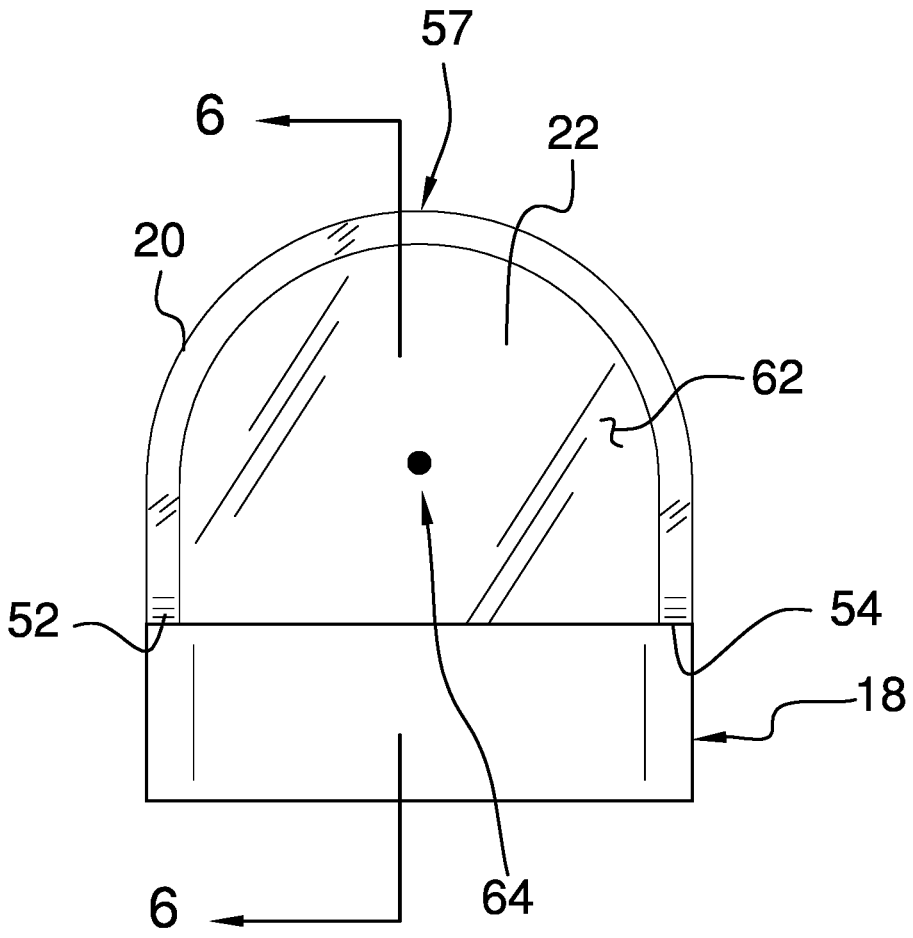
FIG. 4 is a back view of an embodiment of the disclosure.
Figure 5:
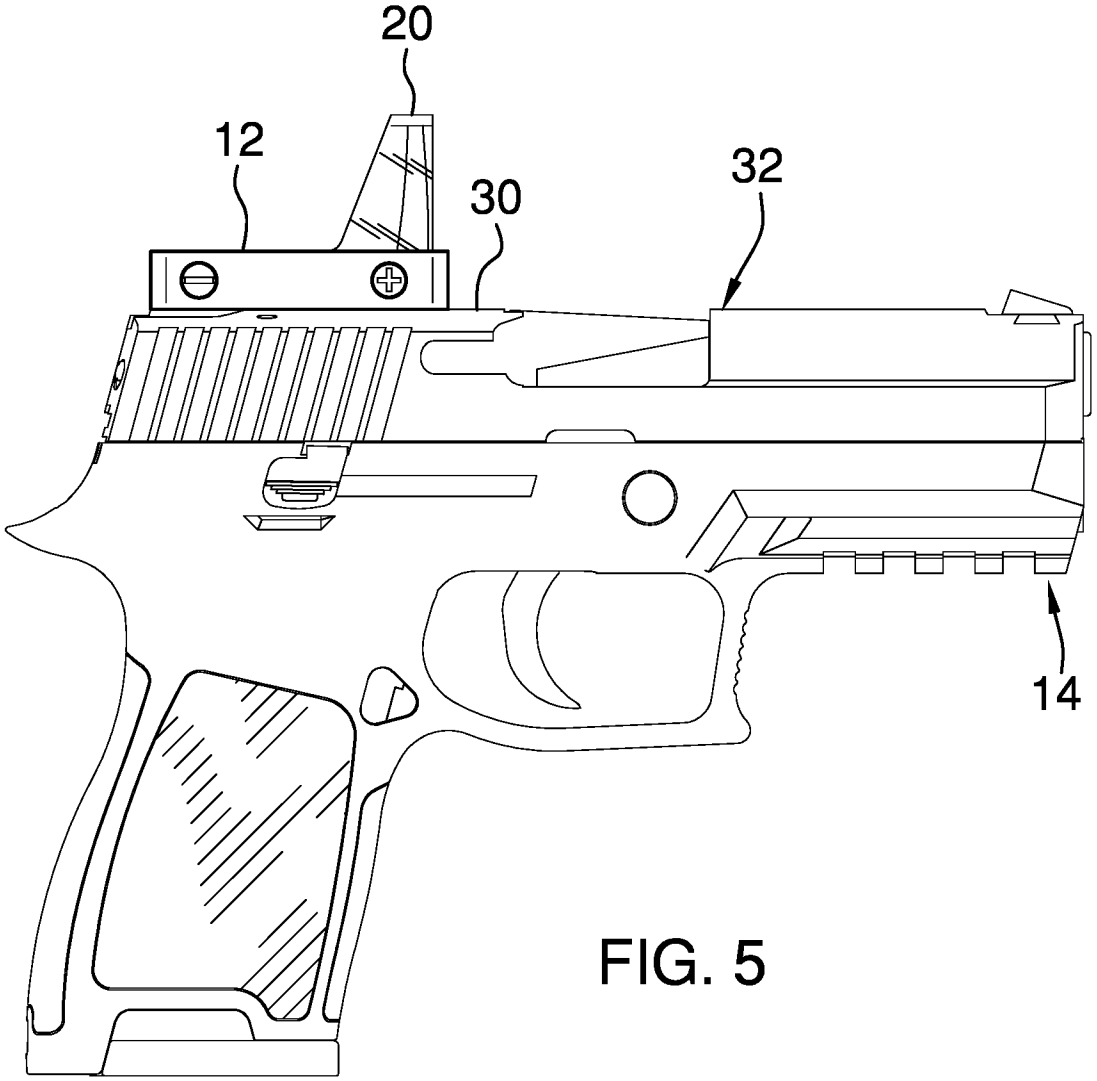
FIG. 5 is a perspective in-use view of an embodiment of the disclosure.
Figure 6:
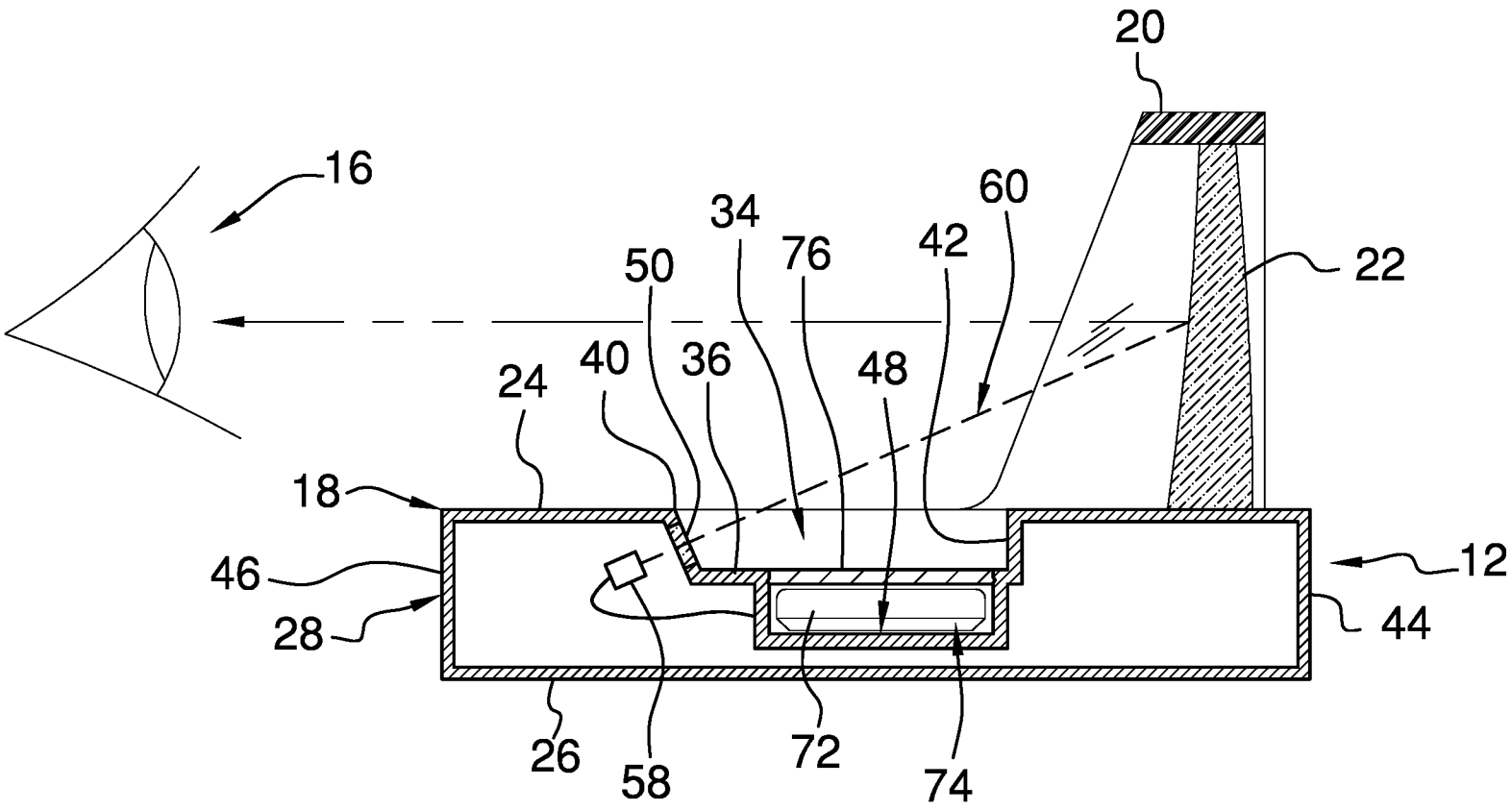
FIG. 6 is a cross sectional view taken along line 6-6 of FIG. 4 of an embodiment of the disclosure.

With reference now to the drawings, and in particular to FIGS. 1 through 8 thereof, a new laser sight device embodying the principles and concepts of an embodiment of the disclosure and generally designated by the reference numeral 10 will be described.

As best illustrated in FIGS. 1 through 8, the laser dot sight device 10 generally comprises a red dot sight 12 that is mountable to a firearm 14 to facilitate a shooter 16 to aim the firearm 14 with the red dot sight 12. The red dot sight 12 includes an emitter housing 18, a lens housing 20 extending upwardly from the emitter housing 18 and a lens 22 integrated into the lens housing 20. The lens housing 20 is comprised of a translucent material, including but not being limited to polycarbonate, glass or epoxy resin, thereby facilitating light to pass through the lens housing 20. In this way the lens housing 20 facilitates the shooter 16 to have unimpeded peripheral vision while looking through the red dot sight 12. The firearm 14 may be a handgun, a long rifle or any other type of firearm 14 upon which the red dot sight 12 could be mounted.

The emitter housing 18 has a top surface 24, a bottom surface 26 and an outer surface 28 extending between the top surface 24 and the bottom surface 26. The bottom surface 26 is mounted to a top 30 of a barrel 32 of the firearm 14 and the top surface 24 has a well 34 extending downwardly toward the bottom surface 26. The well 34 has a lower bounding surface 36 and a lateral bounding surface 38 and the lateral bounding surface 38 has a rear side 40 and a forward side 42. Additionally, the well 34 is positioned closer to a front side 44 of the outer surface 28 than a back side 46 of the outer surface 28 and the emitter housing 18 is elongated between the front side 44 and the back side 46.

The rear side 40 of the lateral bounding surface 38 slops rearwardly between the lower bounding surface 36 of the well 34 and the top surface 24 of the emitter housing 18. Additionally, the lower bounding surface 36 has a battery well 48 extending toward the bottom surface 26 of the emitter housing 18. A window 50 is integrated into the rear side 40 of the lateral bounding surface 38 of the well 34 and the window 50 is centrally located along the rear side 40.

The lens housing 20 has a first end 52, a second end 54 and a rear edge 56 extending between the first end 52 and the second end 54. The lens housing 20 is curved between the first end 52 and the second end 54 such that the first end 52 is spaced from the second end 54 having the lens housing 20 defining a U-shape. Each of the first end 52 and the second end 54 is attached to the top surface 24 of the emitter housing 18 having the lens housing 20 curving upwardly from the emitter housing 18. The rear edge 56 slopes rearwardly between an apex 57 of the lens housing 20 and each of the first end 52 and the second end 54. Additionally, the lens 22 extends upwardly from the top surface 24 of the emitter housing 18 such that the lens 22 fills an opening defined by the lens housing 20.

The red dot sight 12 includes a light emitter 58 that is positioned within the emitter housing 18. The light emitter 58 emits a beam of concentrated light 60 outwardly through the window 50 and onto a rear face 62 of the lens 22. In this way the beam of concentrated light 60 produces a dot 64 on the rear face 62 of the lens 22 to facilitate the shooter 16 to aim the firearm 14. The light emitter 58 may comprise a light emitting diode or other type of electronic light emitter commonly associated with laser pointers.

A brightness adjustment 66 is rotatably integrated into the emitter housing 18 and the brightness adjustment 66 is electrically coupled to the light emitter 58. The brightness adjustment 66 adjusts an intensity of the beam of concentrated light 60 between a minimum intensity and a maximum intensity. A windage adjustment 68 is rotatably integrated into the outer surface 28 of the emitter housing 18 and the windage adjustment 68 is in mechanical communication with the light emitter 58. The windage adjustment 68 adjusts the light emitter 58 to the left or to the right to facilitate the shooter 16 to adjust the aim of the firearm 14 along a horizontal axis. An elevation adjustment 70 is rotatably integrated into the top surface 24 of the emitter housing 18 and the elevation adjustment 70 is in mechanical communication with the light emitter 58. The elevation adjustment 70 adjusts the light emitter 58 up or down to facilitate the shooter 16 to adjust the aim of the firearm 14 along a vertical axis.

Figure 7:
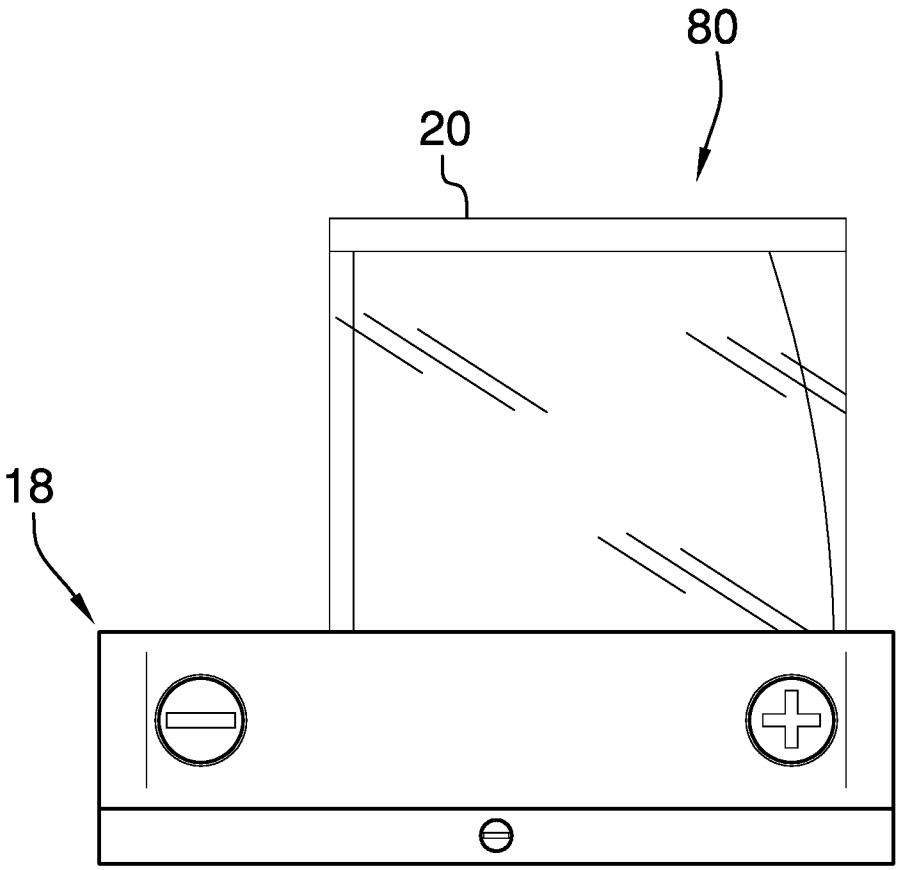
FIG. 7 is a right side view of an alternative embodiment of the disclosure.
Figure 8:
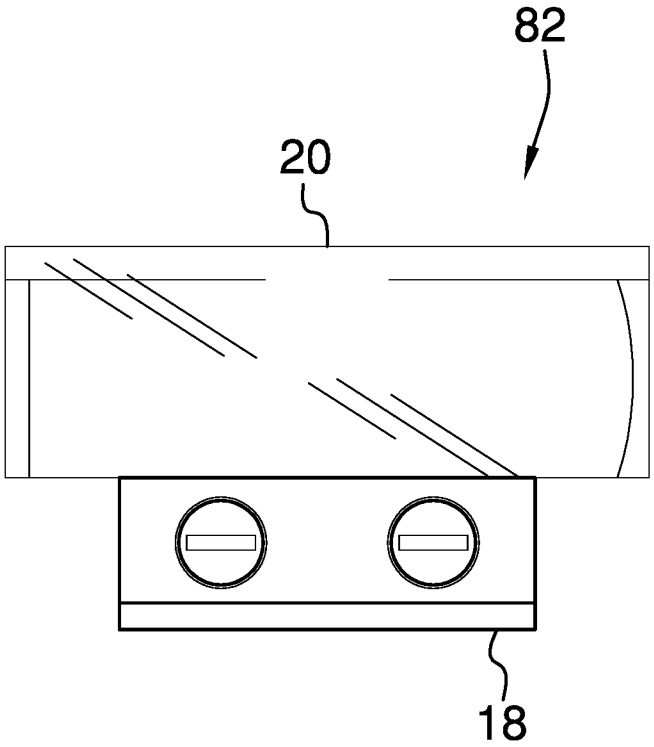
FIG. 8 is a perspective view of an alternative embodiment of the disclosure.

A power supply 72 is removably positioned in the battery well 48 and the power supply 72 is electrically coupled to the light emitter 58. Additionally, the power supply 72 comprises at least one battery 74. A battery cover 76 is removably attached to the lower bounding surface 36 of the well 34 in the top surface 24 of the emitter housing 18 for closing the battery well 48. A pair of mounting screws 78 extends downwardly through the lower bounding surface 36 of the well 34 and engages the firearm 14 to attach the emitter housing 18 to the firearm 14. In an alternative embodiment 80 as shown in FIG. 7, the lens housing 20 may extend along the majority of the length of the emitter housing 12. In an alternative embodiment 82 as shown in FIG. 8, the lens housing 20 may have a length that is greater than the length of the emitter housing 12.

In use, the shooter 16 looks through the lens housing 20 to employ the dot 64 on the rear face 62 of the lens 22 to aim the firearm 14. The translucent material of the lens housing 20 facilitates the shooter 16 to have unimpeded peripheral vision through the lens housing 20 while the shooter 16 is aiming the firearm 14. In this way the shooter 16 can remain focused on the target while being able to employ their peripheral vision. Thus, the shooter 16 has a more comprehensive view of the shooting range while aiming the firearm 14 to enhance safety for the shooter 16 and for individuals at the shooting range.

With respect to the above description then, it is to be realized that the optimum dimensional relationships for the parts of an embodiment enabled by the disclosure, to include variations in size, materials, shape, form, function and manner of operation, device and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A laser dot sight device for a firearm having a translucent housing to facilitate peripheral vision while aiming the firearm, said device comprising:

a red dot sight being mountable to a firearm wherein said red dot sight is configured to facilitate a shooter to aim said firearm with said red dot sight, said red dot sight including an emitter housing and a lens housing extending upwardly from said emitter housing and a lens being integrated into said lens housing, said lens housing being comprised of a translucent material thereby facilitating light to pass through said lens housing wherein said lens housing is configured to facilitate the shooter to have unimpeded peripheral vision while looking through said red dot sight.

2. The device according to claim 1, wherein:

said emitter housing has a top surface, a bottom surface and an outer surface extending between said top surface and said bottom surface, said bottom surface being mounted to a top of a barrel of said firearm;

said top surface has a well extending downwardly toward said bottom surface, said well having a lower bounding surface and a lateral bounding surface, said lateral bounding surface having a rear side and a forward side, said well being positioned closer to a front side of said outer surface than a back side of said outer surface;

said emitter housing being elongated between said front side and said back side; and said rear side of said lateral bounding surface slopes rearwardly between said lower bounding surface of said well and said top surface of said emitter housing.

3. The device according to claim 2, wherein said lower bounding surface has a battery well extending toward said bottom surface of said emitter housing.

4. The device according to claim 2, wherein said emitter housing has a window being integrated into said rear side of said lateral bounding surface of said well, said window being centrally located along said rear side.

5. The device according to claim 4, wherein said red dot sight includes a light emitter being positioned within said emitter housing, said light emitter emitting a beam of concentrated light outwardly through said window and onto a rear face of said lens wherein said beam of concentrated light is configured to produce a dot on said rear face of said lens to facilitate the shooter to aim said firearm.

6. The device according to claim 5, further comprising a brightness adjustment being rotatably integrated into said emitter housing, said brightness adjustment being electrically coupled to said light emitter, said brightness adjustment adjusting an intensity of said beam of concentrated light between a minimum intensity and a maximum intensity.

7. The device according to claim 5, further comprising a windage adjustment being rotatably integrated into said outer surface of said emitter housing, said windage adjustment being in mechanical communication with said light emitter, said windage adjustment adjusting said light emitter to the left or to the right wherein said windage adjustment is configured to facilitate the shooter to adjust the aim of said firearm along a horizontal axis.

8. The device according to claim 5, further comprising an elevation adjustment being rotatably integrated into said top surface of said emitter housing, said elevation adjustment being in mechanical communication with said light emitter, said elevation adjustment adjusting said light emitter up or down wherein said elevation adjustment is configured to facilitate the shooter to adjust the aim of said firearm along a vertical axis.

9. The device according to claim 2, wherein:

said lens housing has a first end and a second end and a rear edge extending between said first end and said second end, said lens housing being curved between said first end and said second end such that said first end is spaced from said second end having said lens housing defining a U-shape, each of said first end and said second end being attached to said top surface of said emitter housing having said lens housing curving upwardly from said emitter housing; and said lens extends upwardly from said top surface of said emitter housing such that said lens fills an opening defined by said lens housing.

10. The device according to claim 9, wherein said rear edge slopes rearwardly between an apex of said lens housing and each of said first end and said second end.

11. A laser dot sight device for a firearm having a translucent housing to facilitate peripheral vision while aiming the firearm, said device comprising:

a red dot sight being mountable to a firearm wherein said red dot sight is configured to facilitate a shooter to aim said firearm with said red dot sight, said red dot sight including an emitter housing and a lens housing extending upwardly from said emitter housing and a lens being integrated into said lens housing, said lens housing being comprised of a translucent material thereby facilitating light to pass through said lens housing wherein said lens housing is configured to facilitate the shooter to have unimpeded peripheral vision while looking through said red dot sight, said emitter housing having a top surface, a bottom surface and an outer surface extending between said top surface and said bottom surface, said bottom surface being mounted to a top of a barrel of said firearm, said top surface having a well extending downwardly toward said bottom surface, said well having a lower bounding surface and a lateral bounding surface, said lateral bounding surface having a rear side and a forward side, said well being positioned closer to a front side of said outer surface than a back side of said outer surface, said emitter housing being elongated between said front side and said back side, said rear side of said lateral bounding surface sloping rearwardly between said lower bounding surface of said well and said top surface of said emitter housing, said lower bounding surface having a battery well extending toward said bottom surface of said emitter housing, said emitter housing having a window being integrated into said rear side of said lateral bounding surface of said well, said window being centrally located along said rear side, said lens housing having a first end and a second end and a rear edge extending between said first end and said second end, said lens housing being curved between said first end and said second end such that said first end is spaced from said second end having said lens housing defining a U-shape, each of said first end and said second end being attached to said top surface of said emitter housing having said lens housing curving upwardly from said emitter housing, said rear edge sloping rearwardly between an apex of said lens housing and each of said first end and said second end, said lens extending upwardly from said top surface of said emitter housing such that said lens fills an opening defined by said lens housing, said red dot sight including a light emitter being positioned within said emitter housing, said light emitter emitting a beam of concentrated light outwardly through said window and onto a rear face of said lens wherein said beam of concentrated light is configured to produce a dot on said rear face of said lens to facilitate the shooter to aim said firearm;

a brightness adjustment being rotatably integrated into said emitter housing, said brightness adjustment being electrically coupled to said light emitter, said brightness adjustment adjusting an intensity of said beam of concentrated light between a minimum intensity and a maximum intensity;

a windage adjustment being rotatably integrated into said outer surface of said emitter housing, said windage adjustment being in mechanical communication with said light emitter, said windage adjustment adjusting said light emitter to the left or to the right wherein said windage adjustment is configured to facilitate the shooter to adjust the aim of said firearm along a horizontal axis;

an elevation adjustment being rotatably integrated into said top surface of said emitter housing, said elevation adjustment being in mechanical communication with said light emitter, said elevation adjustment adjusting said light emitter up or down wherein said elevation adjustment is configured to facilitate the shooter to adjust the aim of said firearm along a vertical axis;

a power supply being removably positioned in said battery well, said power supply being electrically coupled to said light emitter, said power supply comprising at least one battery; and a battery cover being removably attached to said lower bounding surface of said well in said top surface of said emitter housing for closing said battery well.

12. A laser dot sight system for a firearm having a translucent housing to facilitate peripheral vision while aiming the firearm, said device comprising:

a firearm having a barrel;

a red dot sight being mountable to said firearm wherein said red dot sight is configured to facilitate a shooter to aim said firearm with said red dot sight, said red dot sight including an emitter housing and a lens housing extending upwardly from said emitter housing and a lens being integrated into said lens housing, said lens housing being comprised of a translucent material thereby facilitating light to pass through said lens housing wherein said lens housing is configured to facilitate a shooter to have unimpeded peripheral vision while looking through said red dot sight, said emitter housing having a top surface, a bottom surface and an outer surface extending between said top surface and said bottom surface, said bottom surface being mounted to a top of said barrel of said firearm, said top surface having a well extending downwardly toward said bottom surface, said well having a lower bounding surface and a lateral bounding surface, said lateral bounding surface having a rear side and a forward side, said well being positioned closer to a front side of said outer surface than a back side of said outer surface, said emitter housing being elongated between said front side and said back side, said rear side of said lateral bounding surface sloping rearwardly between said lower bounding surface of said well and said top surface of said emitter housing, said lower bounding surface having a battery well extending toward said bottom surface of said emitter housing, said emitter housing having a window being integrated into said rear side of said lateral bounding surface of said well, said window being centrally located along said rear side, said lens housing having a first end and a second end and a rear edge extending between said first end and said second end, said lens housing being curved between said first end and said second end such that said first end is spaced from said second end having said lens housing defining a U-shape, each of said first end and said second end being attached to said top surface of said emitter housing having said lens housing curving upwardly from said emitter housing, said rear edge sloping rearwardly between an apex of said lens housing and each of said first end and said second end, said lens extending upwardly from said top surface of said emitter housing such that said lens fills an opening defined by said lens housing, said red dot sight including a light emitter being positioned within said emitter housing, said light emitter emitting a beam of concentrated light outwardly through said window and onto a rear face of said lens wherein said beam of concentrated light is configured to produce a dot on said rear face of said lens to facilitate the shooter to aim said firearm;

a brightness adjustment being rotatably integrated into said emitter housing, said brightness adjustment being electrically coupled to said light emitter, said brightness adjustment adjusting an intensity of said beam of concentrated light between a minimum intensity and a maximum intensity;

a windage adjustment being rotatably integrated into said outer surface of said emitter housing, said windage adjustment being in mechanical communication with said light emitter, said windage adjustment adjusting said light emitter to the left or to the right wherein said windage adjustment is configured to facilitate the shooter to adjust the aim of said firearm along a horizontal axis;

an elevation adjustment being rotatably integrated into said top surface of said emitter housing, said elevation adjustment being in mechanical communication with said light emitter, said elevation adjustment adjusting said light emitter up or down wherein said elevation adjustment is configured to facilitate the shooter to adjust the aim of said firearm along a vertical axis;

a power supply being removably positioned in said battery well, said power supply being electrically coupled to said light emitter, said power supply comprising at least one battery; and a battery cover being removably attached to said lower bounding surface of said well in said top surface of said emitter housing for closing said battery well.

* * * * *